US006840837B2

(12) United States Patent
Kobayashi

(10) Patent No.: US 6,840,837 B2
(45) Date of Patent: Jan. 11, 2005

(54) RACING GAME MACHINE

(75) Inventor: Yusuke Kobayashi, Tokyo (JP)

(73) Assignee: Konami Corporation, Tokyo (JP)

( * ) Notice: Subject to any disclaimer, the term of this patent is extended or adjusted under 35 U.S.C. 154(b) by 211 days.

(21) Appl. No.: 10/015,563

(22) Filed: Dec. 17, 2001

(65) Prior Publication Data

US 2002/0090882 A1 Jul. 11, 2002

(30) Foreign Application Priority Data

Jan. 10, 2001 (JP) ..... P.2001-002424

(51) Int. Cl.[7] ..... A63H 33/26; A63F 9/14

(52) U.S. Cl. ..... 446/136; 446/133; 446/446; 463/63

(58) Field of Search ..... 446/444, 446, 446/454, 455, 456, 136, 135; 463/6, 7, 58–59, 60–63, 64–65

(56) References Cited

U.S. PATENT DOCUMENTS 4,066,021 A * 1/1978 Helm ..... 104/138.1
4,589,345 A * 5/1986 Fujita ..... 105/170
4,618,271 A * 10/1986 Li ..... 384/461
5,320,351 A * 6/1994 Suzuki ..... 463/6
5,382,021 A * 1/1995 Tatesaka et al. ..... 463/61
5,469,036 A * 11/1995 Eto ..... 318/581
5,472,192 A * 12/1995 Eto ..... 463/6
5,601,490 A * 2/1997 Nakagawa et al. ..... 463/63
5,649,863 A * 7/1997 Wada et al. ..... 463/62
5,688,175 A * 11/1997 Matsuura et al. ..... 463/61
5,716,275 A * 2/1998 Wada et al. ..... 463/62
5,741,181 A * 4/1998 Nakagawa et al. ..... 463/6
5,865,661 A * 2/1999 Cyrus et al. ..... 446/136
5,954,584 A * 9/1999 Yagi ..... 463/60
6,102,770 A * 8/2000 Cyrus et al. ..... 446/444
6,322,415 B1 * 11/2001 Cyrus et al. ..... 446/130

FOREIGN PATENT DOCUMENTS

JP 9-28922 A 2/1997
JP 2634069 B2 4/1997
JP 09122352 A * 5/1997 ..... A63F/9/14
JP 09261944 A * 10/1997 ..... H02K/41/03
JP 11-90035 4/1999
JP 11300027 A * 11/1999 ..... A63F/9/14
JP 11300028 A * 11/1999 ..... A63F/9/14
JP 11300030 A * 11/1999 ..... A63F/9/14
JP 11300031 A * 11/1999 ..... A63F/9/14
JP 2003024618 A * 1/2003 ..... A63F/9/14

* cited by examiner

*Primary Examiner*—Jessica Harrison
*Assistant Examiner*—Alex F. R. P. Rada, II
(74) *Attorney, Agent, or Firm*—Sughrue Mion, PLLC

(57) ABSTRACT

In a racing game machine, a traveling field, on which platen dots are provided, extends below a racing track. A plurality of self-propelled members are provided on the traveling field. Each self-propelled member includes a first linear motor a second linear motor for propelling the self-propelled member in an arbitrary direction on the traveling field, and includes a first magnet provided in an upper portion thereof. A plurality of miniature members are provided on the racing track to be raced with each other, while being associated with the respective self-propelled members. Each miniature member includes front wheels and rear wheels provided on a bottom face thereof for supporting the miniature member on the racing track. The front wheels are provided as caster wheels. A second magnet is provided in a front side of the caster wheels while being magnetically coupled with the first magnet.

11 Claims, 10 Drawing Sheets

RACING GAME MACHINE

BACKGROUND OF THE INVENTION

The present invention relates to a game machine using self-propelled members, and more particularly, to a racing game machine which facilitates travel control of the self-propelled members, significantly simplifies a mechanical structure and control system of the game machine, and significantly curtails manufacturing costs.

A travel driving mechanism of a self-propelled member used in a racing game machine basically drives wheels by a rotary drive motor and effects turning action by controlling a rotational speed differential between the left driving wheel and the right driving wheel. Japanese Patent No. 2650643 discloses an example of such a racing game machine. In the racing game machine, a racing track is formed into a two-story structure in which self-propelled members are caused to travel on a traveling field to attractively guide miniatures which are incapable of self-propelling are caused to race with each other on a racing track by way of magnetic force originating from magnets.

Electrical wires are arranged in the X and Y directions densely on a plane on which the self-propelled members travel (hereinafter called as traveling field). The electrical wires serve as position detecting wires to detect traveling positions of the self-propelled members. On the basis of detected position information, the self-propelled members are subjected to feedback control, thereby implementing trackless travel. A known position detecting method includes the steps of: capturing a self-propelled member by a CCD camera, subjecting the thus-captured image to image processing, and detecting a traveling position of the self-propelled member on a virtual traveling field through computation.

Nowadays, the information processing speed of a microcomputer and the information storage capacity of memory have been remarkably improved. Against this backdrop, feedback control of travel of a self-propelled member on the position detecting information is comparatively easy in terms of technique.

However, in an actual racing game machine, a self-propelled member travels through use of driving wheels. As a result of slippage, the member may be thrown into a skid and deviate from a racing track, become greatly deviated from a desired direction, or overturn. Thus, feedback control poses a problem in the accuracy of control of a traveling route, in the response of correction of a traveling direction of a self-propelled member, and in the response of correction of a track of the self-propelled member. In reality, unexpected racing is effected often. Thus, difficulty is encountered in causing self-propelled members to race with each other as planned.

On the premise that self-propelled members would cause slippage and deviate from tracks, a plurality of self-propelled members are simultaneously controlled so as to travel by effecting feedback control on the basis of position detecting information while correction is made to movement of the self-propelled members. In this case, a control system and a control program become complicated.

Even in the case of a member which travels, drives, and turns by frictional force developing between wheels and a travel face, it is theoretically conceivable that the member effects feedforward control instead of feedback control on the basis of position detecting information. It is readily predicted that a travel control program for the member and design thereof would be simple. Considerable difficulty is encountered in causing a plurality of self-propelled members in a game machine to accurately travel along predetermined traveling paths through feedforward control. Causing self-propelled members to race with each other in a racing game machine through such feedforward control as planned is almost impossible.

In relation to travel control operation based on feedback control as described the above, the traveling position of a self-propelled member is detected successively, and arithmetic operation is performed on the basis of the thus-detected position so that the traveling is controlled in accordance with a predetermined program. However, in such a configuration, a position sensor, an information processing system, and a travel control system are complicated and involve considerably high manufacturing costs.

SUMMARY OF THE INVENTION

The present invention is aimed at putting considerable thought into the mechanical structure and travel control mechanism of a self-propelled member, by thoroughly changing a travel driving unit and travel control method of a self-propelled member provided in a game machine, by causing a miniature to smoothly and accurately travel along a predetermined traveling path and by quickly changing the orientation of the miniature, while controlling travel of a self-propelled member without use of position detecting information.

In order to achieve the above object, according to the present invention, there is provided a racing game machine, comprising:

a racing track;

a traveling field, on which platen dots are provided, extending below the racing track;

a plurality of self-propelled members provided on the traveling field, each self-propelled member including:

- a first yoke, which constitutes a first linear motor together with the platen dots for propelling the self-propelled member in a first direction on the traveling field;
- a second yoke, which constitutes a second linear motor together with the platen dots for propelling the self-propelled member in a second direction which is perpendicular to the first direction; and
- a first magnet provided in an upper portion of the self-propelled member; and a plurality of miniature members, which are provided on the racing track to be raced with each other while being associated with the respective self-propelled members, each miniature member including:

- front wheels and rear wheels provided on a bottom face thereof for supporting the miniature member on the racing track, the front wheels being provided as caster wheels; and
- a second magnet provided in a front side of the caster wheels while being magnetically coupled with the first magnet.

Here, the caster wheel is a wheel whose axle shaft is supported so as to be rotatable about a vertical axis; i.e., within a horizontal plane.

In this configuration, controlling power supplied to the first and the second yokes to constitute a planar linear motor, the self-propelled member can be propelled on the two-dimensional traveling field at an arbitrary speed and in an arbitrary direction while orienting in a certain direction.

In principle of the planar linear motor, the self-propelled member actually travels as if tracing a kinked line (or in a stepped manner). However, in reality, one step of the self-propelled member in the first and the second directions when traveling obliquely can be made considerably minute. Hence, the self-propelled member is viewed as if traveling substantially linearly. The same also applies to a case where the self-propelled member turns its traveling direction.

Since the miniature is towed by the self-propelled member via the magnetic force, the miniature turns its direction with a slight time lag so as to follow turning action of the self-propelled member. The traveling direction of the miniature is smoothed by an amount corresponding to the time lag. As a result, the miniature travels along a path which is apparently curved. Hence, the miniature travels linear in an oblique line and travels along a predetermined path while smoothly turning a direction in a curved manner.

Since the self-propelled member is driven to travel by a planar linear motor, the self-propelled member travels along a predetermined path accurately and without fail. Consequently, the self-propelled member can be caused to travel along a predetermined path accurately through feed-forward control without use of travel position detecting information.

The bottom face of the miniature member is supported by rear wheels and caster wheels (front wheels). The second magnet provided in a position forward of the front wheels is towed by the first magnet provided in the self-propelled member by way of a magnetic force developing therebetween. When a change is made in the traveling direction of the self-propelled member, the caster wheels used as front wheels are turned naturally. As a result, the miniature member is naturally turned to the thus-changed traveling direction of the self-propelled member. Thus, the miniature member keeps traveling while being turned to the changed traveling direction of the self-propelled member. Therefore, the miniature member can travel while being oriented in a traveling direction in a natural posture, without involvement of addition of a special control mechanism. The realism of a racing game imitating, e.g., a horserace or a car race, can be enhanced by employment of a simple mechanical structure.

Preferably, ball bearings are provided on the bottom face of the self-propelled member to assist the propelling on the traveling field.

Since a ball bearing has no directionality when rotating, the self-propelled member can smoothly slide in every direction within the X-Y plane on the traveling field.

Here, it is preferable that the ball bearings are composed of at least three independent ball bearings.

Alternatively, it is preferable that the ball bearings are supported within an annular holder formed on the bottom face of the self-propelled member to constitute a thrust bearing.

Alternatively, it is preferable that nozzles from which air is brown toward the bottom face of the self-propelled member are formed on the traveling field to form an air bearing layer between the bottom face and the traveling field to support the self-propelled member thereon.

In this configuration, the self-propelled member is supported by an air bearing constituted of a thin air layer. The self-propelled member travels over the traveling field while slightly being supported and levitated by the air layer. Consequently, traveling resistance of the self-propelled member is diminished. The self-propelled member can travel freely by small traveling and driving force originating from the planar linear motor.

Here, it is preferable that a skirt member is formed on a peripheral portion of the bottom face of the self-propelled member.

In this configuration, the skirt member effectively captures an air flow blown from the nozzles formed on the traveling field. Hence, the self-propelled member can be slightly levitated from the travel face by a relatively weak air flow from the nozzles.

Alternatively, it is preferable that the self-propelled member includes a compressor for blowing compressed air toward the traveling field through nozzles formed on the bottom side thereof, to form an air bearing layer between the bottom face and the traveling field to support the self-propelled member thereon.

In this configuration, a construction for creating an air bearing for supporting individual traveling members in a freely-movable manner is simple. The amount of required compressed air is minimal, and the influence of sprayed compressed air to other elements is minimized.

Preferably, each of the first yoke and the second yoke is formed with three legs provided with coils, to constitute three-phase linear motors.

Since three-phase planar linear motor enables smooth travel of the self-propelled member without involvement of stepping-out, the miniature can be traveled more smoothly.

Here, it is preferable that a lower end portion of each leg is split into plural projections each having an identical width with a width of each of the platen dots.

In this configuration, the driving force of each yoke can be increased, thus improving the accuracy of travel control to a much greater extent.

Preferably, the second magnet is pivotable about a pivot center provided on the bottom face of the miniature member at a front side of the front wheels.

Alternatively, the second magnet is rotatable about a rotation center provided on the bottom face of the miniature member at a front side of the front wheels.

In the above configurations, when a change arises in traveling direction of the self-propelled member, the second magnet pivots or rotates so as to follow the change. The guided magnet is brought into a skid and towed in an obliquely horizontal direction. The caster wheels turn their directions with a superior following performance, and the miniature member turns its direction smoothly. Thus, it is prevented the miniature member from falling on the side thereof due to a transverse component of traction force.

The first magnet and the second magnet are realized by simply arranging an S pole and an N pole so as to oppose each other. The magnets pull each other but have no function of transmitting torque. Consequently, the magnets can rotate mutually.

Preferably, the miniature member includes a ball bearing provided on the bottom face thereof in the vicinity of the second magnet, for supporting the miniature member on the racing track.

In this configuration, downward force originating from the first magnet acts on the second magnet of the miniature member. Since the force is applied to the ball bearing, there can be prevented occurrence of instability in the miniature member in the front-rear direction thereof, which would otherwise be caused by downward force originating from the first magnet.

Further, it is preferable that the ball bearings are made of metal, and a conductive layer is formed on the traveling field for supplying power to the linear motors of the self-propelled member via the ball bearings.

In this configuration, the ball bearings can be utilized as power supply terminals, thereby simplifying the construction of a power supply mechanism.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A travel driving unit of a self-propelled member is based on a planar linear motor. The basic mechanism and operation principle of the planar linear motor will be described as follows.

Figure 1:
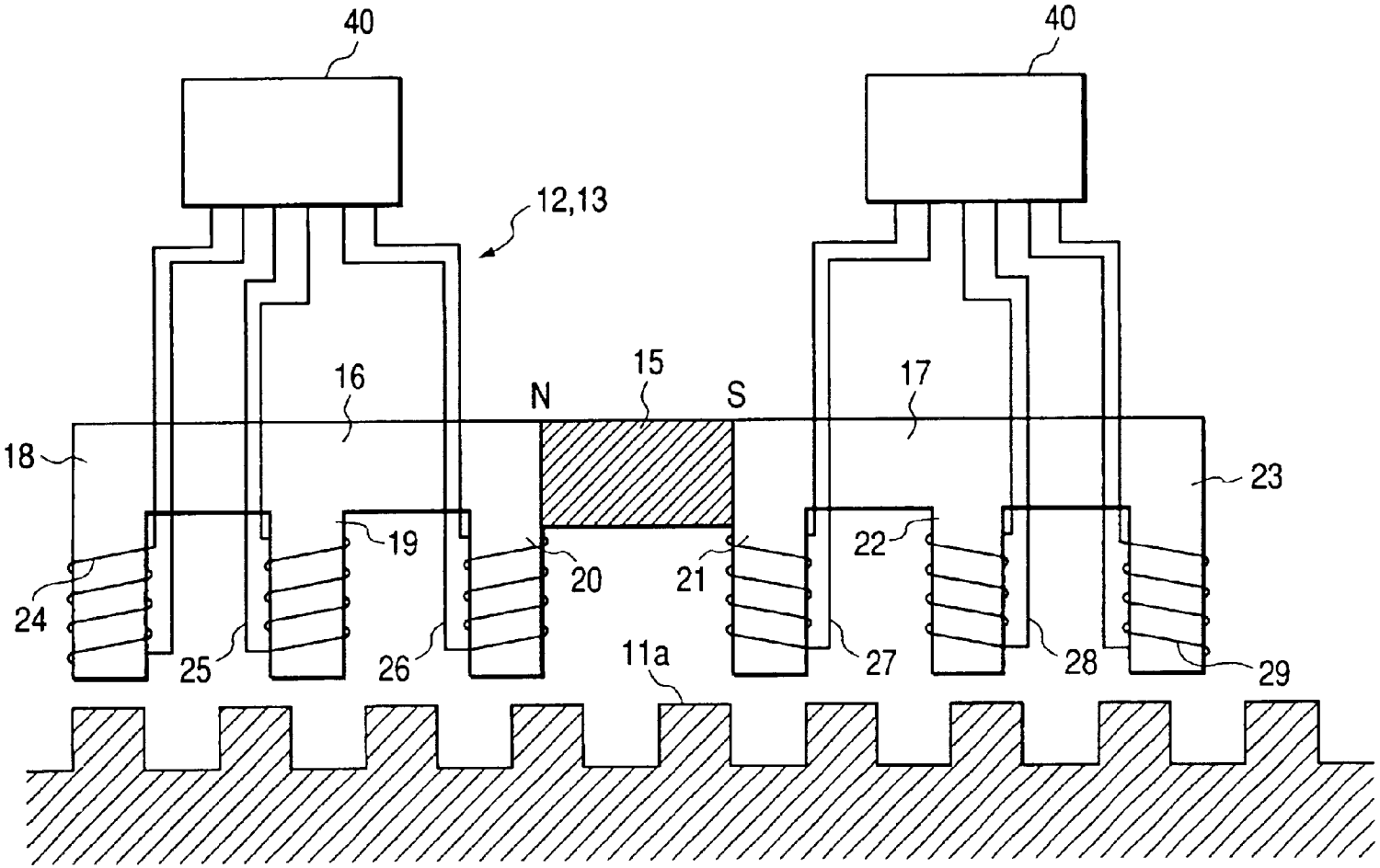
FIG. 1 is a schematic cross-sectional view showing an X-direction mobile yoke and a Y-direction mobile yoke of a three-phase planar linear motor.
Figure 2:
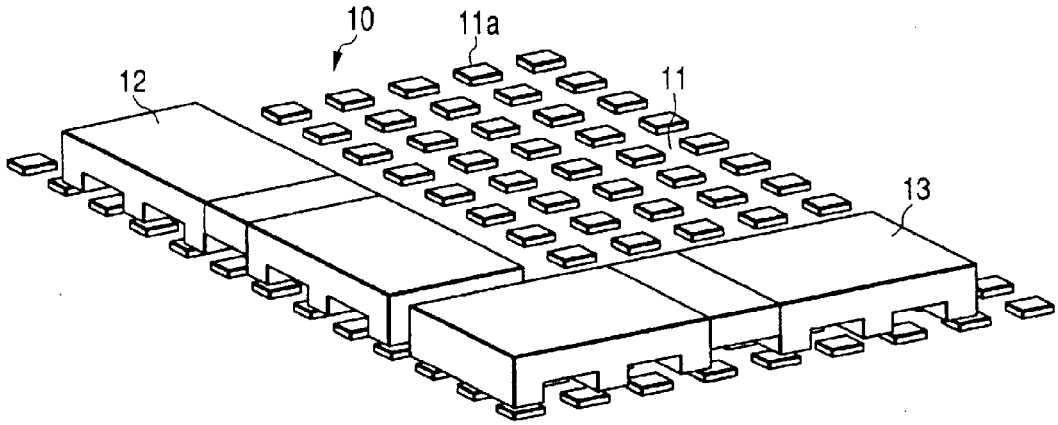
FIG. 2 is a schematic perspective view showing a platen, the X-direction mobile yoke, and the Y-direction mobile yoke.
Figure 3:
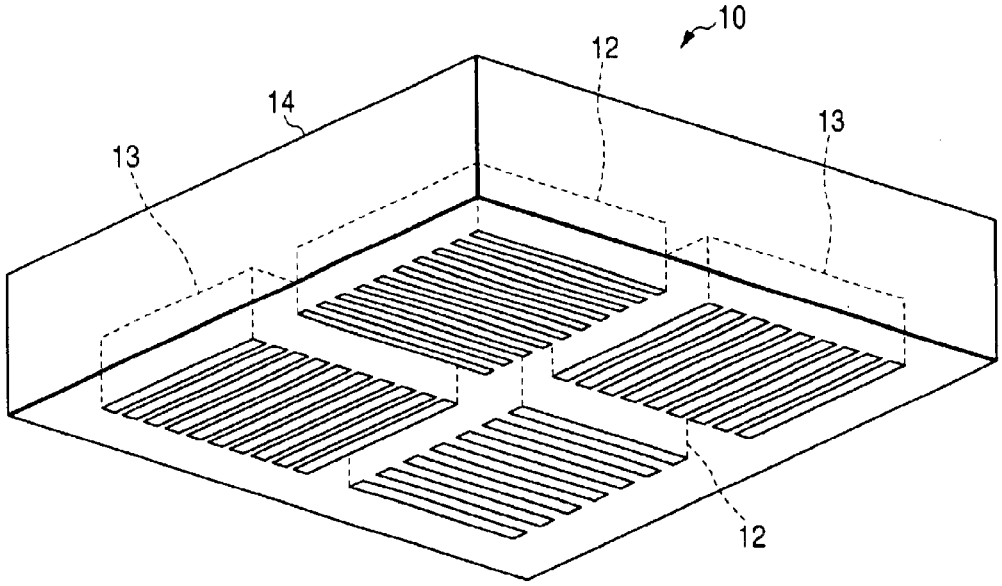
FIG. 3 is a perspective view showing a casing of the three-phase planar linear motor.

As shown in FIGS. 1 to 3, a three-phase planar linear motor 10 is provided with a platen 11 on which platen dots 11*a* are provided and a casing 14 (see FIG. 3) provided so as to move freely over the platen 11. Two X-direction mobile yokes 12 for actuating the linear motor 10 in an X direction and two Y-direction mobile yokes 13 for actuating the linear motor 10 in a Y direction are accommodated in the casing 14. FIG. 2 shows the three-phase planar linear motor 10 while it is removed from the casing 14 for the purpose of convenience, where one X-direction mobile yoke 12 and one Y-direction mobile yoke 13 are illustrated. As shown in FIG. 1, the X-direction mobile yoke 12 is substantially identical in structure with the Y-direction mobile yoke 13. Each of the X-direction mobile yoke 12 and the Y-direction mobile yoke 13 is provided with a permanent magnet 15 and a pair of yokes 16 and 17 provided on both sides of the permanent magnet 15. The yoke 16 has three legs 18, 19, and 20 extending toward the platen 11, and the yoke 17 has three legs 21, 22, and 23 extending toward the platen 11. Each width of the legs 18, 19, 20, 21, 22, and 23 is substantially identical with a width of the platen dots 11*a*.

A U-phase coil 24 is coiled around the leg 18; a V-phase coil 25 is coiled around the leg 19; and a W-phase coil is coiled around the leg 26. A three-phase current flows into the U-phase coil 24, the V-phase coil 25, and the W-phase coil 26. A U'-phase coil 27 is coiled around the leg 21; a V'-phase coil 28 is coiled around the leg 22; and a W'-phase coil 29 is coiled around the leg 23. The three-phase current flows into the U'-phase coil 27, the V'-phase coil 28, and the W'-phase coil 29.

The pitch at which the legs 18, 19, and 20 of the yoke 16 are arranged is 120° out of phase with the pitch at which the platen dots 11*a* are arranged. Similarly, the pitch at which the legs 21, 22, and 23 of the yoke 17 are arranged is 120° out of phase with the pitch at which the platen dots 11*a* are arranged. The positional relationship between the platen dots 11*a* of the legs 21, 22, and 23 is 180° out of phase with the positional relationship between the platen dots 11*a* of the legs 18, 19, and 20.

Figure 6:
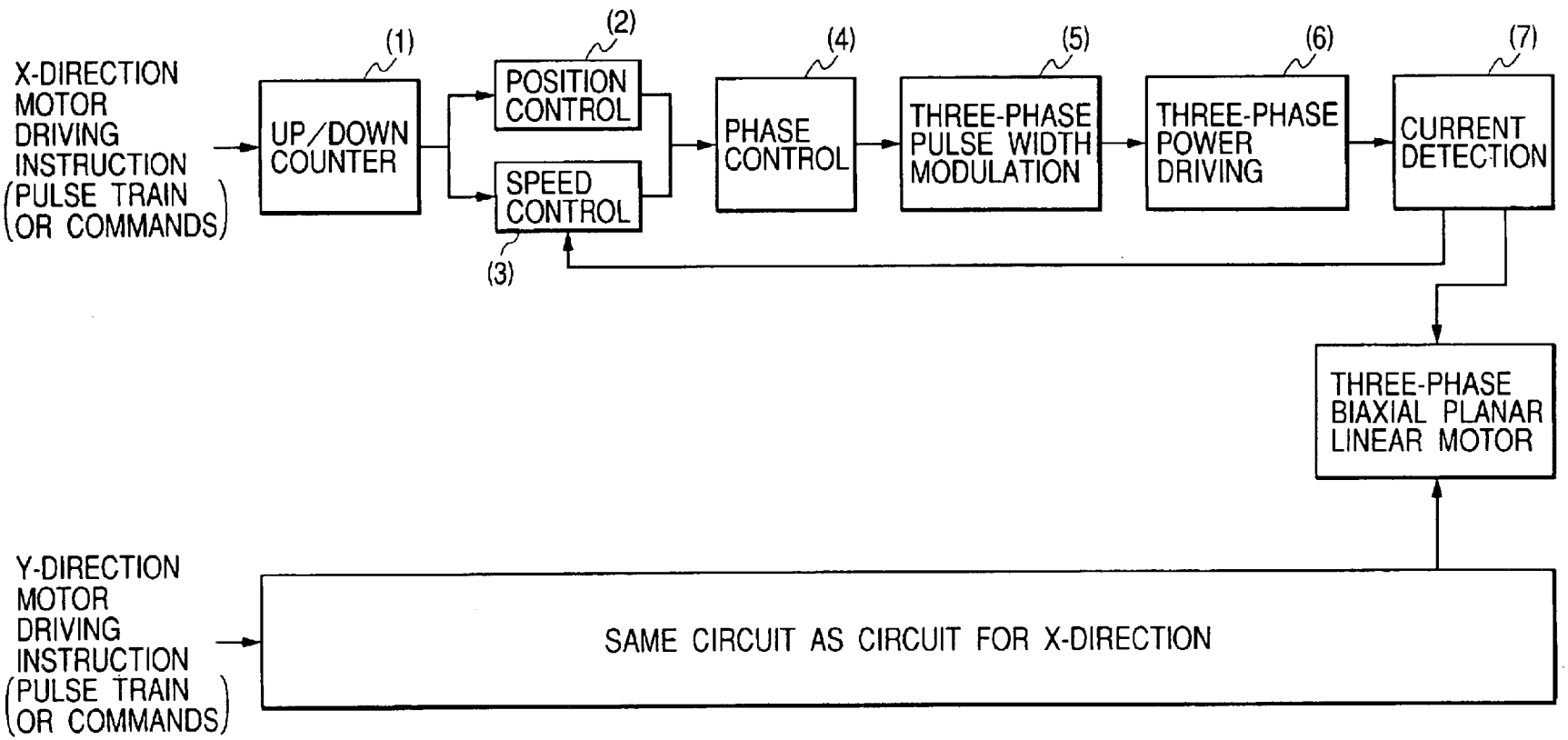
FIG. 6 is a block diagram showing a drive controller for driving the three-phase planar linear motor.

As shown in FIG. 6, a planar linear motor is actuated, by inputting, into a drive controller 40, a pulse train proportional to the amount of travel.

(1) a pulse train and a moving direction are first input into an up/down counter provided in the drive controller 40 as a motor driving instruction for ascertaining an absolute position;

(2) prepare information about a position to which the self-propelled member is to travel, on the basis of a value of the counter;

(3) prepare speed information in accordance with a speed at which the counter changes;

(4) prepare a three-phase traveling waveform corresponding to the two information items;

(5) the electric current is subjected to pulse width modulation (PWM) proportional to a current to be caused to flow to each of the three-phases coils 24 through 29 (this operation is performed to prevent excessive power loss occurred in the drive controller 40 if an electric current of the waveform may be caused to flow into the three-phase coils 24 through 29);

(6) a switch circuit is controlled by a pulse-width-modulated on/off signal, thereby producing three-phase electric power;

(7) an electric current is detected so as to make pulse width modulation proportional to an output electric current, in order to shut down the self-propelled member in the event of occurrence of excessive current as a result of accidents;

In the case of command control, a commitment (command) to be input for operating a linear motor has been determined beforehand, and the linear motor is controlled through use of the command. A command analysis circuit produces a pulse train from the command in (1), and subsequent processing is identical with that mentioned above.

Next, a three-phase electric current flows from the drive controller 40 to the U-phase coil 24, the V-phase coil 25, and the W-phase coil 26 of the X-direction mobile yoke 12. Simultaneously, a three-phase electric current having the same current waveform as that flowing into the X-direction mobile yoke 12 flows into the U'-phase coil 27, the V'-phase coil 28, and the W'-phase coil 29. In this case, the three-phase electric current flowing into the U-phase coil 24, the V-phase coil 25, and the W-phase coil 26 is opposite in direction with that flowing into the U'-phase coil 27, the V'-phase coil 28, and the W'-phase coil 29. A set of three-phase current output devices enables simultaneous flow of an electric current to the U-phase coil 24, the V-phase coil 25, and the W-phase 26 and to the U'-phase 27, the V'-phase 28, and the W'-phase 29. At this time, the X-direction mobile yoke 12 undergoes horizontal driving force exerted by the platen 11 in the X direction.

In the meanwhile, air is blown against the platen 11 by way of air nozzles (not shown) provided in the casing 14. As a result, the casing 14 is levitated slightly from the platen 11. The entirety of the casing 14 is then moved in the X direction.

If inversion of movement of the casing 14 in the X direction is desired, offset phase angles of the electric currents flowing through any two coils of the U-phase coil 24, the V-phase coil 25, and the W-phase coil 26 are inverted. Further, offset phase angles of the electric currents flowing through any two coils of the U'-phase coil 27, the V'-phase coil 28, and the W'-phase coil 29 are inverted so as to correspond to those of the electric currents flowing through the U-phase coil 24, the V-phase coil 25, and the W-phase coil 26. In this way, the casing 14 can be moved back and forth in the X direction.

An electric current is caused to flow into the Y-direction mobile yoke 13 in the same manner as in the X-direction mobile yoke 12, thereby enabling back and forth movement of the casing 14 in the Y direction.

The moving direction and travel speed of the casing 14 can be controlled appropriately, by controlling the electric current flowing through the Y-direction mobile yoke 13 and the X-direction mobile yoke 12.

Figure 4:
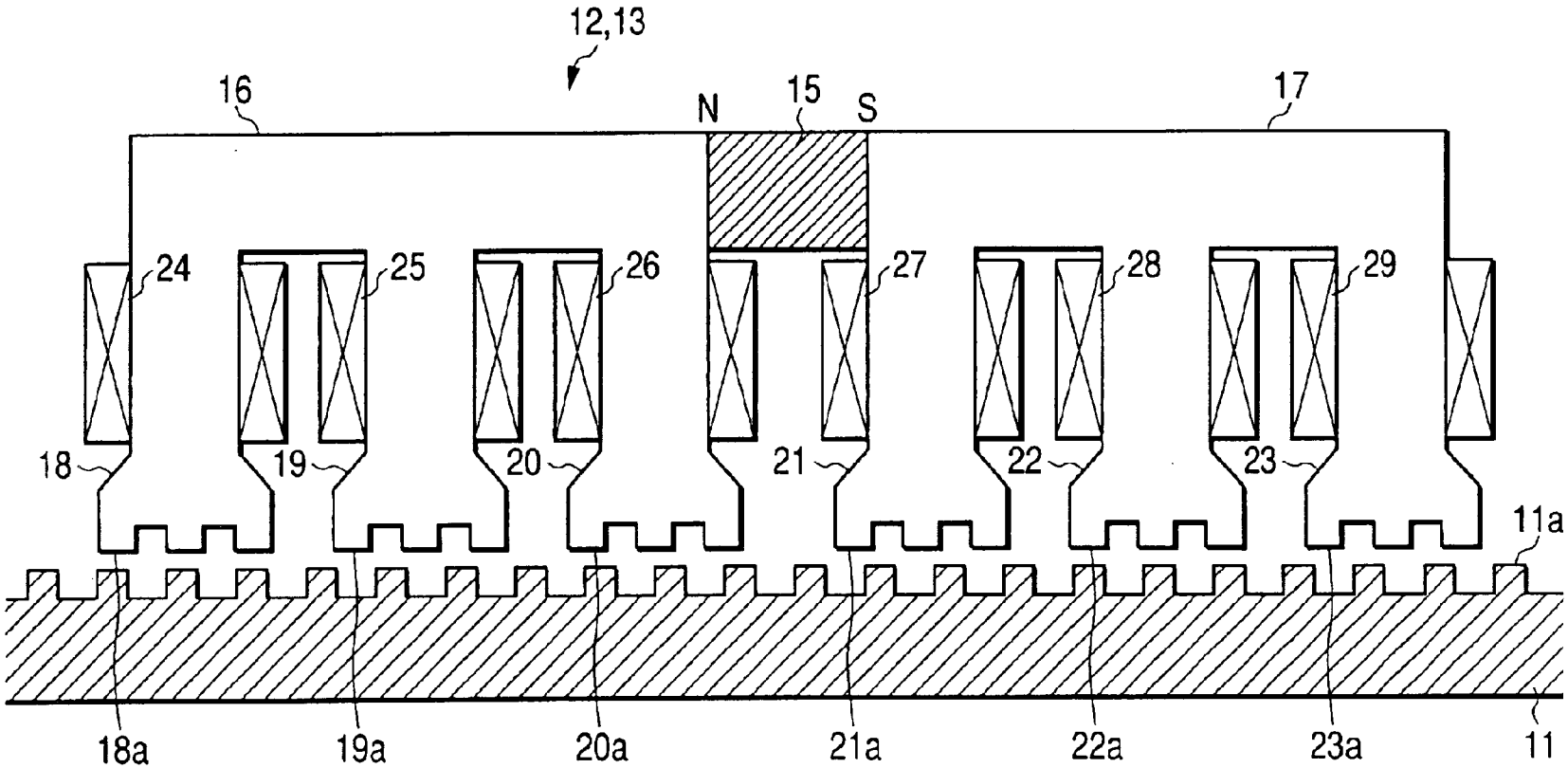
FIG. 4 is a schematic cross-sectional view showing an X-direction mobile yoke and a Y-direction mobile yoke in another example of the three-phase planar linear motor.
Figure 5:
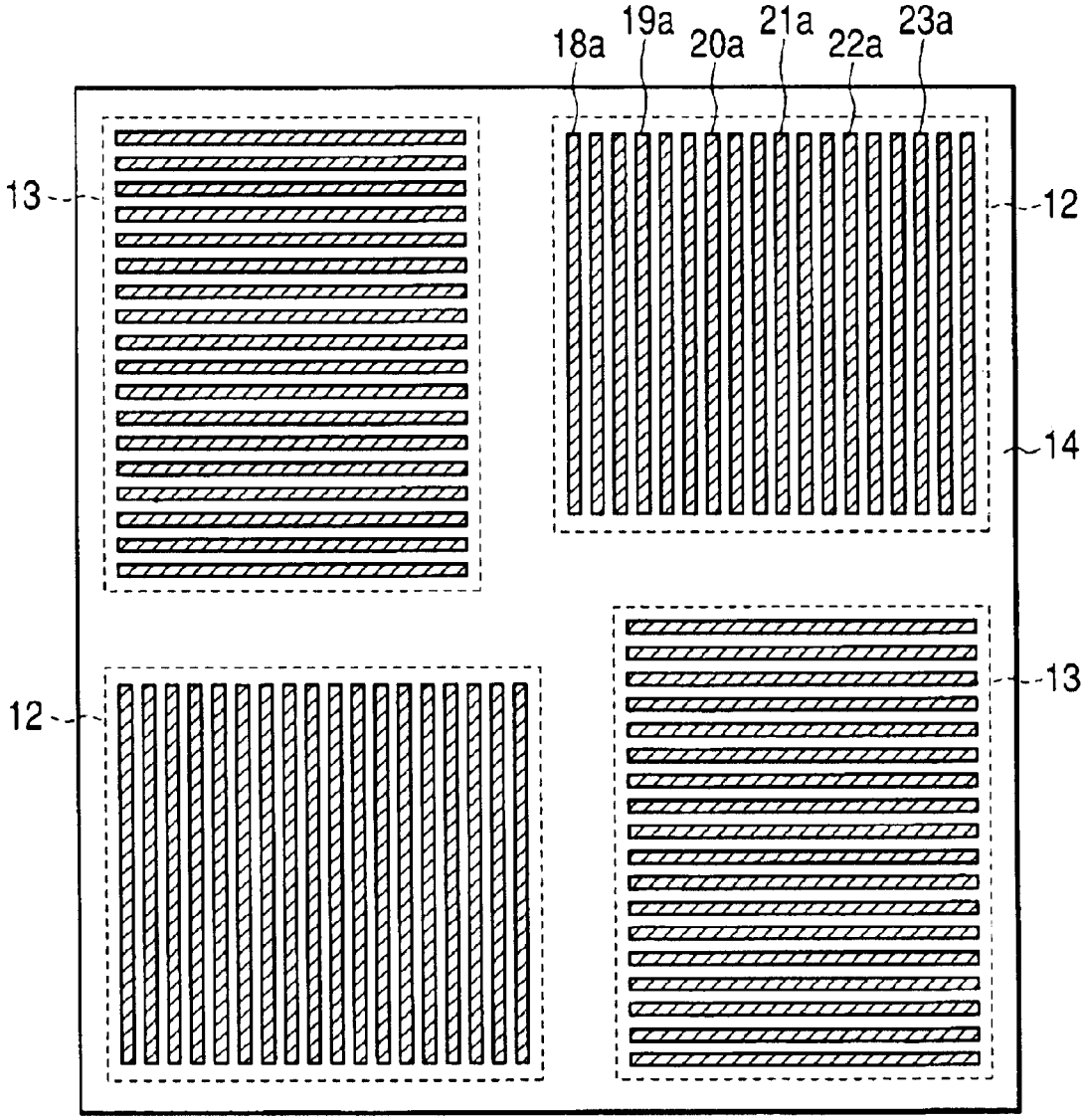
FIG. 5 is a schematic cross-sectional view showing the X-direction mobile yoke and the Y-direction mobile yoke of the three-phase planar linear motor shown in FIG. 4.

In the three-phase planar linear motor shown in FIGS. 4 and 5, the lower end of the leg 18 provided in the X-direction mobile yoke 12 is split into three sub-divisions, thereby constituting three projections 18*a*. Similarly, the lower end of the leg 19 is split into three projections 19*a;* the lower end of the leg 20 is split into three projections 20*a;* the lower end of the leg 21 is split into three projections 21*a;* the lower end of the leg 22 is split into three projections 22*a;* and the lower end of the leg 23 is split into three projections 23*a*.

In other respects, the three-phase planar linear motor shown in FIGS. 4 and 5 is identical with that shown in FIGS. 1 through 3. The platen dots 11*a* of the platen 11 are formed so as to assume the same width as that of the projection 18*a* by which the width of the leg 18 has been made narrow through separation.

Since the lower ends of the legs 18, 19, 20, 21, 22, and 23 are separated into the projections 18*a,* 19*a,* 20*a,* 21*a,* 22*a,* and 23*a,* the driving force of the X-direction mobile yoke 12 and that of the Y-direction mobile yoke 13 can be increased.

Figure 9:
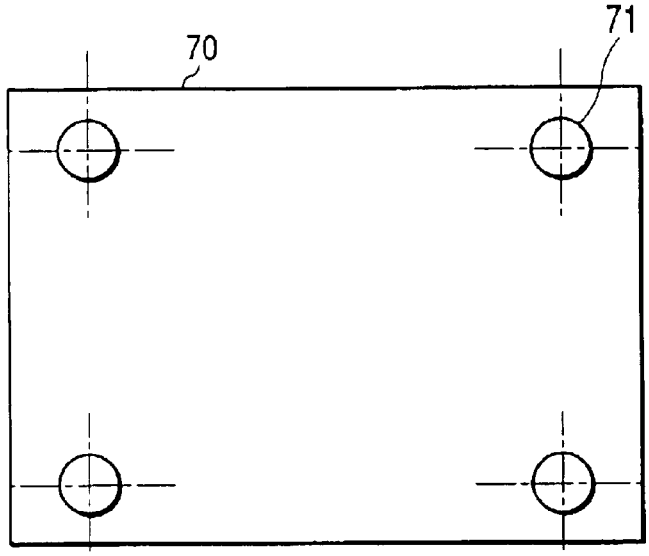
FIG. 9 is a plan view showing the layout of ball bearings of the self-propelled member.

In a first embodiment of the invention, the basic mechanism and operation principle of the travel driving device of the planar linear motor are as have been described above. A travel driving device of a self-propelled member 70 according to the present embodiment is identical with that of the above-described planar linear motor. The self-propelled member 70 travels over a traveling field 90 by four ball bearings 71 (see FIG. 9). The traveling field 90 is provided with a platen 72 having the same platen dots as those shown in FIG. 2.

A planar linear motor 75 (identical with the X-direction mobile yoke 12 and the Y-direction mobile yoke 13 shown in FIGS. 4 and 5) are provided on a lower face of the self-propelled member 70. The planar linear motor 75 is activated by a motor driver 76. A controller 77 communicates a control signal with a central controller of the game machine by way of a communicator 78, whereby the motor driver 76 is controlled by the control signal output from the central controller.

A guide magnet 83 mounted on a base 82 is held on a support 81 in an elevated position above the self-propelled member 70. The upper face of the guide magnet is constituted of a ring-shaped magnet with the N pole facing upward.

Figure 7:
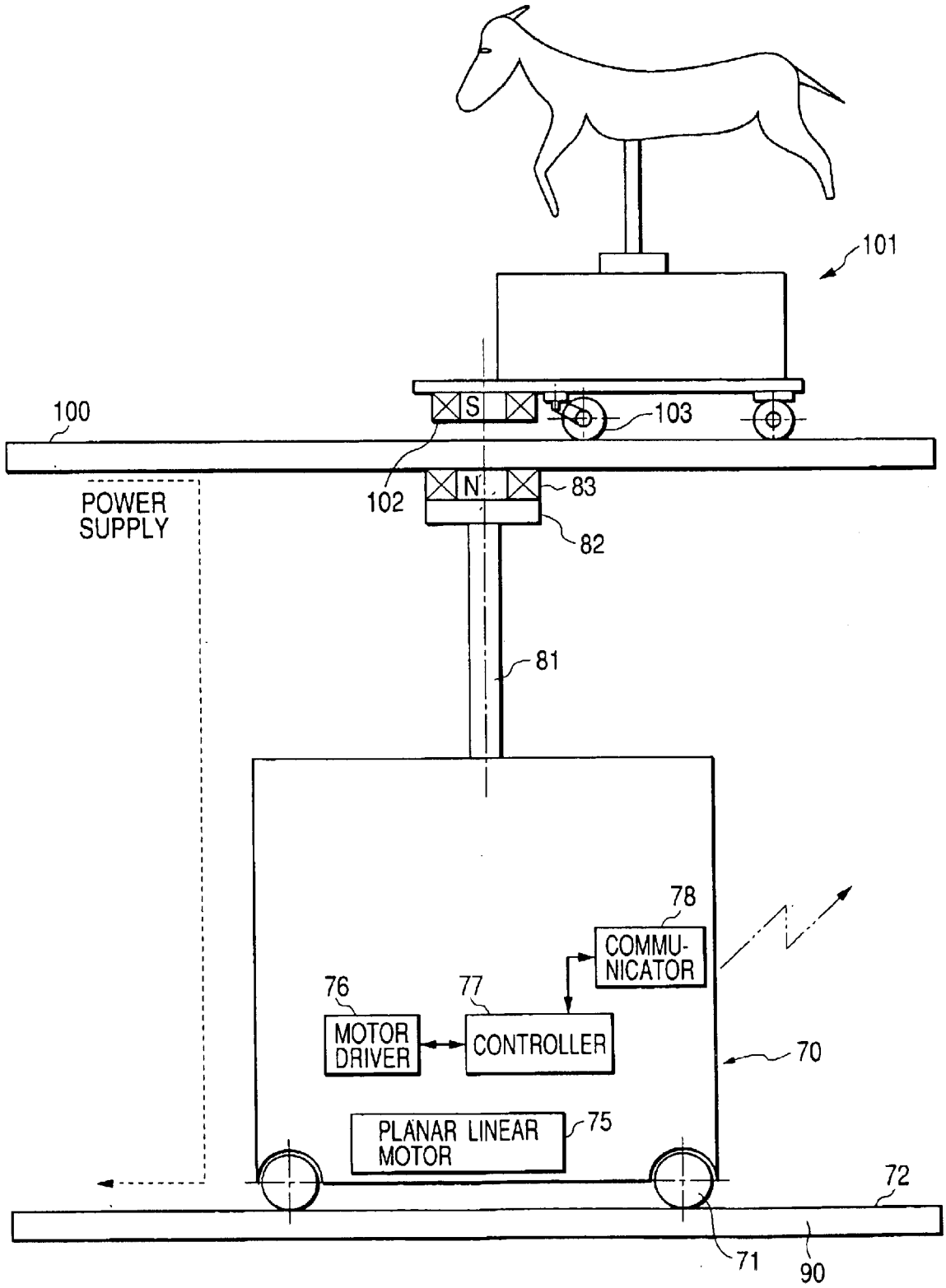
FIG. 7 is a schematic cross-sectional view showing a self-propelled member according to a first embodiment of the present invention.
Figure 11:
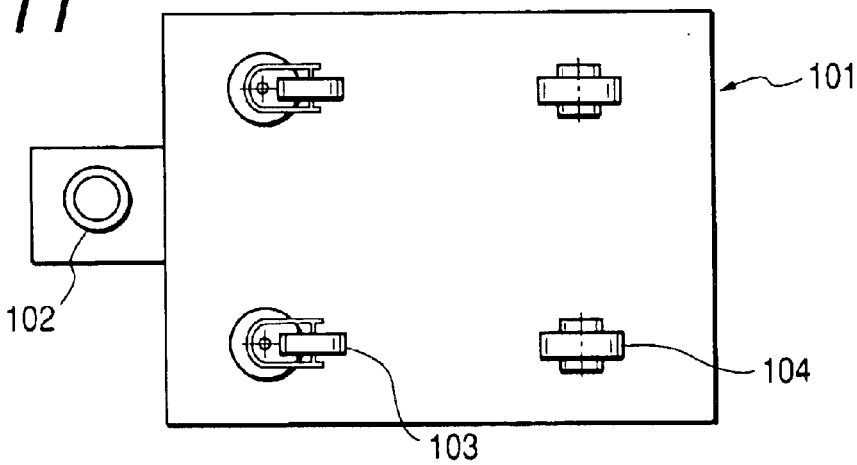
FIG. 11 is a plan view of a bottom side of a miniature member.

As shown in FIGS. 7 and 11, the lower face of a miniature member 101 is supported by two rear wheels 104, and two front wheels 103 constituted of caster wheels. A guided magnet 102 is mounted on a lower face of the miniature member 101 in a position forward of the front wheels 103. The lower face of the guided magnet 102 is formed from a ring-shaped magnet with the S pole facing downward. The guided magnet 102 simply pulls the guide magnet 83 and has no function of transmitting torque. Consequently, the guide magnet 83 and the guided magnet 102 can mutually rotate.

The caster wheels used for the front wheels have axles that are rotatable in a horizontal direction within an X-Y plane with reference to the vertical axis. The rear wheels are ordinary wheels.

The self-propelled member 70 travels in an arbitrary direction within the X-Y plane by the action of the planar linear motor without involvement of change in the posture of the self-propelled member 70 (i.e., a front face thereof still directs frontward). The guide magnet 83 tows the miniature member 101 by way of magnetic force developing between the guide magnet 83 and the guided magnet 102. Since the front wheels 103 of the miniature member are caster wheels, the front wheels 103 are turned so as to follow the direction of traction force. Consequently, when a change has arisen in the towing direction of the guide magnet 83, the miniature member 101 gradually turns its posture toward the towing direction and travels in a natural posture while a match between the orientation and traveling direction of the miniature member 101 is maintained.

When the self-propelled member travels in an oblique direction, the self-propelled member travels obliquely while remaining oriented forward, whilst the miniature member travels in an oblique direction while being orientated in the traveling direction. Here, slight relative rotation has arisen between the guide magnet 83 and the guided magnet 102. Since they constitute a simple pair of magnets which pull each other, no resistance in relative rotation arises.

Figure 8:
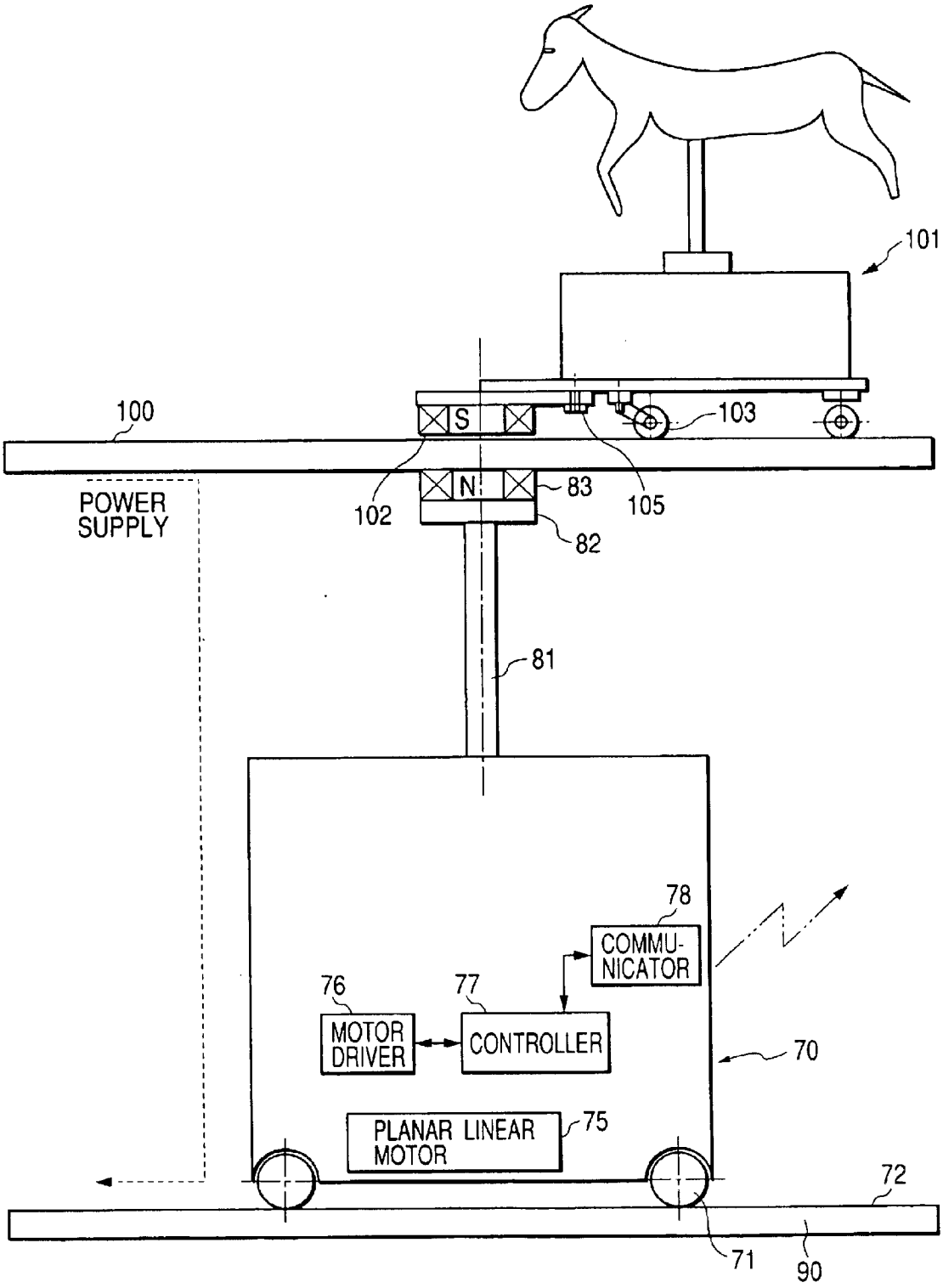
FIG. 8 is a schematic cross-sectional view showing a self-propelled member according to a second embodiment of the invention.

FIG. 8 shows a second embodiment of the invention, in which the guided magnet 102 is pivotably fixed on the lower face of the miniature member 101 in a forward position with a vertical pin 105. In this configuration, when a change has arisen in the traveling direction of the self-propelled member, the guided magnet 102 pivots about the vertical pin 105, and skidding in an obliquely lateral direction arises. Obliquely lateral towing force is transmitted to the miniature member via the area where the guided magnet 102 is provided. The miniature member is towed and turned in an obliquely horizontal direction. Thus, a good following performance is achieved, and it is prevented the miniature member 101 from falling on the side thereof.

In order to prevent occurrence of instability in the miniature member 101, which would otherwise be caused by downward force being exerted on the guided magnet 102 from the guide magnet 83, a ball bearing may be provided in the vicinity of the guided magnet 102 for counteracting the downward force.

The same steering performance can be achieved by use of a ball bearing as the front wheels 103 to be provided on the lower face of the miniature member 101 in lieu of the caster wheels. Since the front portion of the miniature member is turned so as to be drawn horizontally, there inevitably results less smooth turning action than that effected by caster wheels.

Figure 10:
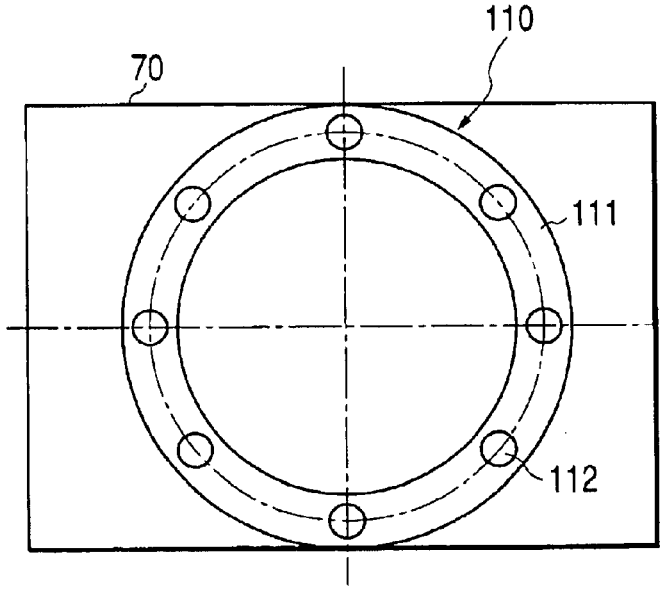
FIG. 10 is a plan view showing another example of the layout of ball bearings.

Ball bearings of the self-propelled member 70 are made of metal. In order to diminish rotational resistance between the ball bearings and an interior face of a retaining section, the balls are held in the retaining section such that linear or point contact exists between the balls and the retaining section. As shown in FIG. 10, a so-called thrust bearing 110 constituted by holding a plurality of balls 112 in an annular retainer 111 can be provided on a lower surface of the self-propelled member 70.

Figure 12:
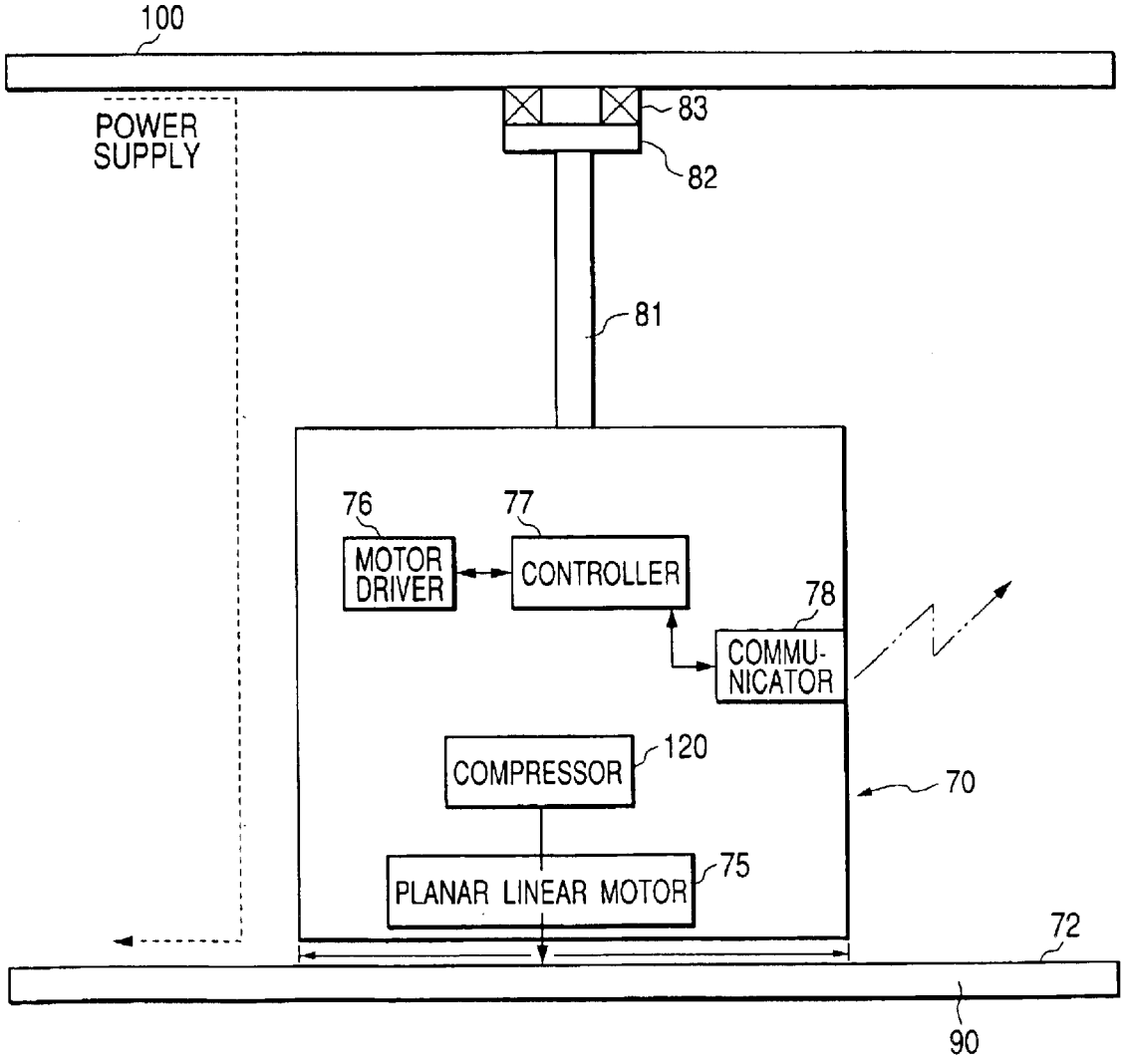
FIG. 12 is a schematic cross-sectional view showing a self-propelled member according to a third embodiment of the present invention.

FIG. 12 shows a third embodiment of the invention, in which an air bearing is adopted. In this embodiment, a compact compressor 120 is mounted on a self-propelled member 70, and the compact compressor 120 causes compressed air to blow by way of a nozzle formed in substantially the center of the lower face of the self-propelled member 70. The air is caused to flow in every direction along the lower face of the self-propelled member 70. A thin air layer (having a thickness of e.g., tens of microns) is formed between the self-propelled member 70 and a traveling face (i.e., the face of the platen 72). The self-propelled member is supported by the air layer. Since slide resistance existing between the self-propelled member 70 and the traveling face is considerably small. Hence, the self-propelled member 70 can travel considerably smoothly and freely with agility in every direction.

When a plurality of openings are formed in the lower face, the openings are arranged such that a balance is achieved with reference to the center of gravity of the self-propelled member.

The configuration shown in FIG. 12A may be adopted. In this case, the compressor 120 is disposed below the platen 72. As indicated by arrows in the figure, air from the compressor 120 is blown toward the lower face of the self-propelled member 70 via opening formed in the platen 72 so that the air is caused to flow in every direction along the lower face of the self-propelled member 70. A thin air layer is accordingly formed between the self-propelled member 70 and the traveling face so that the self-propelled member 70 is supported by the air layer. In a case where a skirt member 84 is provided around a circumferential portion of the lower face of the self-propelled member 70, the formation of such an air layer can be facilitated.

In the first embodiment as shown in FIG. 7, the guided magnet 102 is fastened to the bottom face of the frame of the miniature member 101. Instead, as a fourth embodiment of the invention shown in FIG. 13, the guided magnet 102 is secured to a turn plate 130, and the turn plate 130 can be rotatably attached to the bottom face of the frame of the miniature member 101 with a rotary pin 131. In an actual racing game machine, the racing track of the miniature members is formed from artificial lawns. There is a, case where a miniature member is caused to travel while the guided magnet 102 is brought into slidable contact with the lawn. In this case, if the guided magnet 102 is secured to the lower face of the miniature member, the guided magnet 102 is brought into slidable contact with the lawn on the racing track in a turning direction in association with turning action of the miniature member. The resultant frictional resistance may hinder smooth turning action of the miniature member. However, according to the structure shown in FIG. 13, the turn plate 130 provided with the guided magnet 102 is rotated about the rotary pin 131 with respect to the frame of the miniature member, thereby avoiding occurrence of sliding action between the travel plane and the guided magnet 102 in the turning direction. Consequently, even when a miniature member travels while bringing the guided magnet 102 into slidable contact with the racing track, smooth turning action of the miniature member is ensured. The same discussion also applies to the second embodiment shown in FIG. 8.

A travel control system of a self-propelled member differs in accordance with the nature of a game machine. However, the basic travel control of a self-propelled member is made identical with that of the planar linear motor as described before.

When a plurality of miniature members are caused to race with each other, the traveling paths and speeds of all the self-propelled members are controlled simultaneously in parallel each other by single controller. Further, the turning angles of miniatures of all the self-propelled members are controlled in parallel with each other simultaneously.

Since the self-propelled member is caused to travel by a planar linear motor, the self-propelled member travels accurately in accordance with an instruction in terms of either travel direction or speed. The self-propelled member does not deviate from a scheduled path, which would otherwise be caused by slippage of driving wheels. Hence, self-propelled members do not interfere with each other. Even if interference has arisen between the self-propelled members for any reason, the self-propelled members do not go out of the scheduled traveling paths to such an extent that they become uncontrollable.

For example, when a game is caused to proceed by applying the present invention to a horseracing game machine using ten miniatures, there is a necessity of controlling the ten miniatures in a complicated manner while relating them with each other such that the ten miniatures run in a realistic manner. In order to realize such control operation, travel control data pertaining to individual self-propelled members are set in RAM of the controller beforehand, and all the self-propelled members are concurrently controlled in parallel with each other on the basis of the data.

A method of controlling travel actions of self-propelled members in a horseracing game machine has already been known as described in, e.g., Japanese Patent No. 2650643. A control method for controlling travel actions of self-propelled members in a horseracing game machine is not the gist of the present invention, and hence its explanation is omitted.

Figure 13:
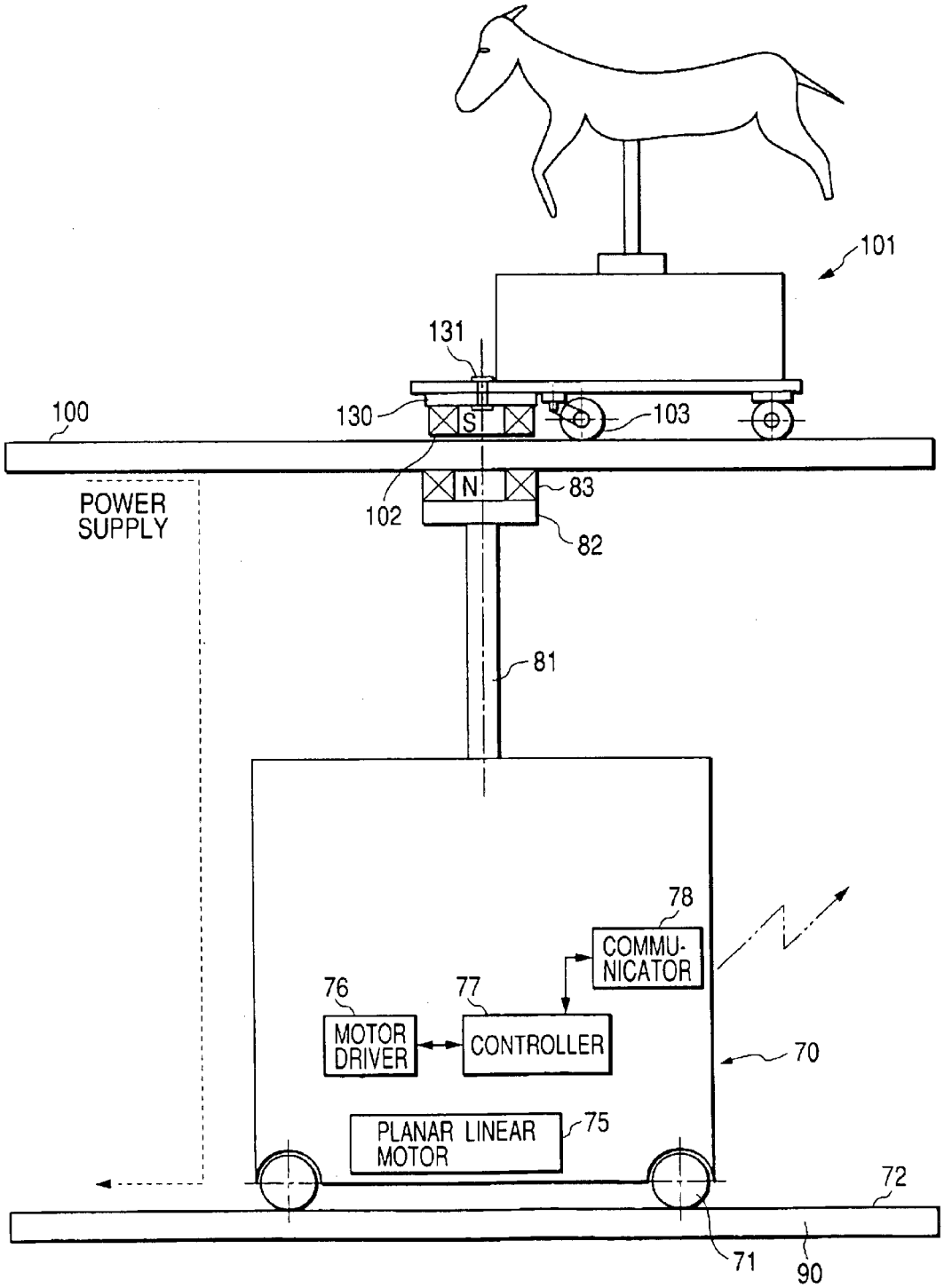
FIG. 13 is a schematic cross-sectional view showing a self-propelled member according to a fourth embodiment of the invention.

Desirably, power to the planar linear motor 73 of a self-propelled member is externally supplied so as not hinder travel of the self-propelled member on the traveling field. For this reason, there is employed a power supply system as shown in FIGS. 7, 8 and 13, wherein the self-propelled member 70 is interposed between the lower face of the racing track 100 and the traveling field 90 which are constituted as conductive planes so that power is supplied to planar linear motors of self-propelled members via the conductive planes (as indicated by dashed lines in the figures). Here, the ball bearings 71 can be utilized as power supply terminals.

However, in the case of the embodiment shown in FIG. 12, the self-propelled member is levitated minutely from the traveling field. Hence, there is a necessity of some contrivance, such as bringing a brush provided in a lower portion of the self-propelled member into slidable contact with the traveling field.

As a matter of course, there may also be possible to employ a power supply mechanism, wherein a power supplier is provided on a lower face of the racing track, and current collectors formed on the self-propelled member are brought into slidable contact with the lower face.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, nozzles from which air is blown toward a bottom face of the self-propelled member may be formed on the traveling field to form an air bearing layer between the bottom face and the traveling field to support the self-propelled member thereon.

In this configuration, the self-propelled member is supported by an air bearing constituted of a thin air layer. The self-propelled member travels over the traveling field while slightly being supported and levitated by the air layer. Consequently, traveling resistance of the self-propelled member is diminished. The self-propelled member can travel freely by small traveling and driving force originating from the planar linear motor.

Here, it is preferable that a skirt member is formed on a peripheral portion of the bottom face of the self-propelled member.

In this configuration, the skirt member effectively captures an air flow blown from the nozzles formed on the traveling field. Hence, the self-propelled member can be slightly levitated from the surface of the traveling field by a relatively weak air flow from the nozzles.

What is claimed is:

1. A racing game machine, comprising:

a racing track;

a traveling field, on which platen dots are provided, extending below the racing track;

a plurality of self-propelled members provided on the traveling field, each self-propelled member including:

a first yoke, which constitutes a first linear motor together with the platen dots for propelling the self-propelled member in a first direction on the traveling field;

a second yoke, which constitutes a second linear motor together with the platen dots for propelling the self-propelled member in a second direction which is perpendicular the first direction; and a first magnet provided in an upper portion of the self-propelled member, and a plurality of miniature members, which are provided on the racing track to be raced with each other while being associated with the respective self-propelled members, each miniature member including:

front wheels and rear wheels provided on a bottom face thereof for supporting the miniature member on the racing track, the front wheels being provided as caster wheels; and a second magnet provided in a front side of the caster wheels while being magnetically coupled with the first magnet.

2. The game machine as set forth in claim 1, wherein ball bearings are provided on the bottom face of the self-propelled member to assist the propelling on the traveling field.

3. The game machine as set forth in claim 2, wherein the ball bearings are composed of at least three independent ball bearings.

4. The game machine as set forth in claim 2, wherein the ball bearings are supported within an annular retainer formed on the bottom face of the self-propelled member to constitute a thrust bearing.

5. The gaming machine as set forth in claim 2, wherein:

the ball bearings are made of metal, and a conductive layer is formed on the traveling field for supplying power to the linear motors of the self-propelled member via the ball bearings.

6. The game machine as set forth in claim 1, wherein each of the first yoke and the second yoke is formed with three legs provided with coils, to constitute three-phase linear motors.

7. The game machine as set forth in claim 6, wherein a lower end portion of each leg is split into plural projections each having an identical width with a width of each of the platen dots.

8. The game machine as set forth in claim 1, wherein the second magnet is pivotable about a pivot center provided on the bottom face of the miniature member at a front side of the front wheels.

9. The game machine as set forth in claim 1, wherein the miniature member includes a ball bearing provided on the bottom face thereof in the vicinity of the second magnet, for supporting the miniature member on the racing track.

10. The game machine as set forth in claim 1, wherein the second magnet is rotatable about a rotation center provided on the bottom face of the miniature member at a front side of the front wheels.

11. A racing game machine, comprising a racing track;

a traveling field, on which platen dots are provided, extending below the racing track, a plurality of self-propelled members provided on the traveling field, each self-propelled member including:

a first yoke, which constitutes a first linear motor together with the platen dots for propelling the self-propelled member in a first direction on the traveling field;

a second yoke, which constitutes a second linear motor together with the platen dots for propelling the self-propelled member in a second direction which is perpendicular to the first direction; and a first magnet provided in an upper portion of the self-propelled member; and a plurality of miniature members, which are provided on the racing truck to be raced with each other while being associated with the respective self-propelled members, each miniature member including:

front wheels and rear wheels provided on a bottom face thereof for supporting the miniature member on the racing track, the front wheels being provided caster wheels; and a second magnet magnetically coupled with the first magnet.

* * * * *